United States Patent [19]

Belcher et al.

[11] Patent Number: 4,651,119

[45] Date of Patent: Mar. 17, 1987

[54] ELECTRIC FUSE HEAT DAM ELEMENT HAVING STIFFENING RIBS

[75] Inventors: Richard A. Belcher, Hampton Falls, N.H.; Robert J. Panaro, Byfield, Mass.

[73] Assignee: Gould Inc., Rolling Meadows, Ill.

[21] Appl. No.: 750,106

[22] Filed: Jun. 28, 1985

[51] Int. Cl.[4] ..... H01H 85/04

[52] U.S. Cl. ..... 337/166; 337/163; 337/297; 338/281

[58] Field of Search ..... 337/158-166, 337/233, 295, 296, 297; 174/133 R; 338/284, 291, 281

[56] References Cited

U.S. PATENT DOCUMENTS 1,889,445 11/1932 Lightfoot ..... 338/281
3,261,950 7/1966 Kozacka .
3,261,952 7/1966 Kozacka .
4,216,457 8/1980 Panaro .

FOREIGN PATENT DOCUMENTS 26252 of 1908 United Kingdom ..... 338/281

*Primary Examiner*—Harold Broome
*Attorney, Agent, or Firm*—Frederick A. Goettel, Jr.

[57] ABSTRACT

An electric fuse is provided with heat dam elements interconnecting the fusible element and the fuse end terminals, which are provided with one or more raised ribs integrally formed therein. The heat dams include a plurality of planar sections and interconnecting bends to which the ribs impart a high degree of stiffness and dimensional stability.

3 Claims, 9 Drawing Figures

ELECTRIC FUSE HEAT DAM ELEMENT HAVING STIFFENING RIBS

BACKGROUND OF THE INVENTION

1. Field of the Invention

The present invention is directed to a manner of achieving rigidity and dimensional stability in a heat dam strip section for use in an electric fuse of the time delay type.

2. Description of the Prior Art

It is well known in the prior art to make use of a heat dam section in an electric fuse to reduce the flow of heat from the fusible element to the end terminals of the fuse. Heat dams typically are formed from sheet metal and comprise a series of U-shaped bends interconnecting a plurality of planar sections to define a tortuous path. Such structure results in a relatively heavy fuse link structure, or one involving a relatively large mass, to achieve a given current rating. Consequently, the lag-times or time delay of such fuses are particularly long making them extremely attractive for application in motor circuits having high motor starting inrush currents.

Such heat dam elements are shown and described in U.S. Pat. No. 3,261,950 issued July 19, 1966, entitled TIME-LAG FUSES HAVING HIGH THERMAL EFFICIENCY, U.S. Pat. No. 3,261,952 issued July 19, 1966, entitled TIME-LAG FUSE WITH RIBBON FUSE LINK HAVING TWO SYSTEMS OF BENDS, and in U.S. Pat. No. 4,216,457 issued Aug. 5, 1980, entitled ELECTRIC FUSE HAVING FOLDED FUSIBLE ELEMENT AND HEAT DAMS.

Typically in such an electric fuse the heat dam sections are made from materials such as copper or commercial bronze and, in some fuse applications, the thickness of the material from which the heat dams are fabricated may be as little as several thousandths of an inch. It has been found that heat dam sections which have been made from very thin sheet material are susceptible to being deformed from their desired shape during handling of the heat dams and various sub-assemblies which include the heat dams during the assembly of a fuse.

Deformation during handling could, for example, result in a pair of adjacent planar sections being extremely close to or actually touching one another. In this situation, it would be possible that an insufficient quantity of pulverulent arc-quenching and cooling filler material would find its way into the region between these planar sections during the filling operation. As a result, during use of the fuse, this region of the heat dam could become a hot-spot and cause undesirable and premature opening of the fuse in the heat dam.

SUMMARY OF THE INVENTION

According to the present invention, a heat dam element made up of a plurality of planar ribbon sections interconnected by integrally formed bends in the element is provided with one or more raised ribs integrally formed in the element and extending at least through the regions of each of the bends thereby imparting a high degree of stiffness to the thus formed heat dam element. The arrangement described affords a high degree of dimensional stability to such heat dam elements thereby assuring that the spacing between adjacent planar sections is maintained during subsequent handling of the elements during assembly of the fuse.

Such an arrangement assures that an adequate quantity of arc quenching and cooling filler material will find its way between adjacent planar elements thus precluding undesirable hot spots in the heat dam sections. Another benefit of the use of one or more stiffening ribs in the heat dam element is to allow the heat dam element to run cooler as a result of additional surface area in contact with the adjacent filler material.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiments when read in connection with the accompanying drawings wherein like numbers have been employed in the different figures to denote the same parts and wherein:

DESCRIPTION OF THE PREFERRED EMBODIMENTS

Figure 1:
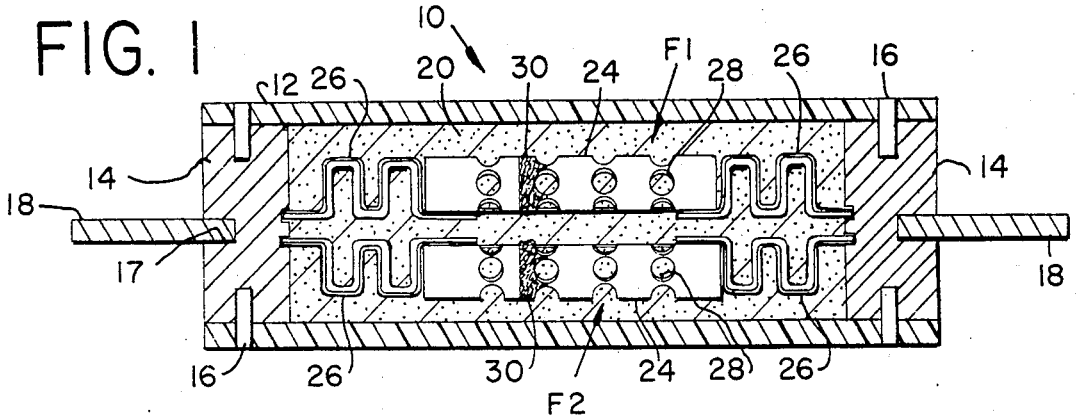
FIG. 1 is a longitudinal sectional view of a fuse embodying this invention.
Figure 2:
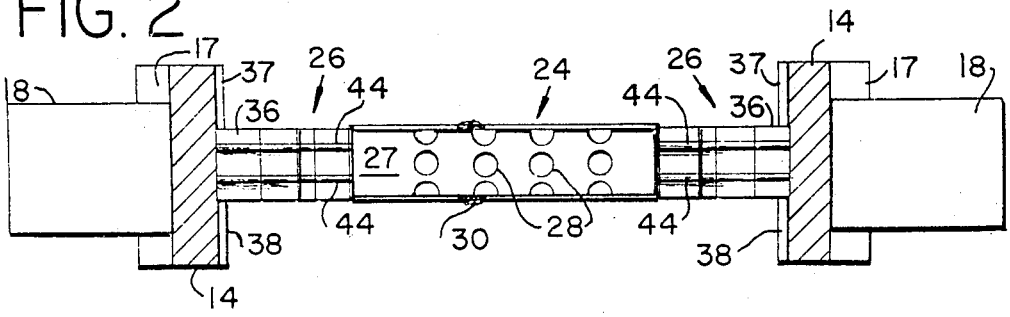
FIG. 2 is an elevational view of a portion of a fusible element, heat dam and end terminal assembly embodying this invention.

Referring first to FIG. 1, reference numeral 10 has been applied generally to an electric fuse of the blade type. The fuse comprises a cylindrical casing 12 of insulating material such as, for instance, a synthetic-resin-glass-cloth laminate. Both ends of the casing 12 are closed by end terminals 14 which are received in the opposite ends of the casing 12 and are retained therein by a plurality of pins 16 passing through axially aligned openings in the casing and the end terminals. Blade contacts 18 are received in mating slots 17 provided in the outside end surface of the end terminals 14 and are suitably electrically affixed to the end terminals by soldering or brazing thereto. The inside of the casing 12 is filled with a pulverulent arc-quenching filler 20, preferably granular quartz or quartz sand. The fuse casing 12 houses a pair of ribbon fuse links F1, F2 of identical configuration, each conductively interconnecting the interior end surfaces of the end terminals 14. Each fuse link Fl, F2 includes a center section 24 and a pair of heat dam elements 26 arranged at opposite axial ends of the center section 24. Each of the center sections 24 comprises a relatively wide fusible section 27, having a plurality of points of reduced cross section 28, and is made from a current limiting material such as sheet silver. In the embodiment of the invention shown in FIGS. 1 through 5 the relatively wide center section 27 is made of silver and has four serial lines of circular perforations, each line defines a plurality of points 28 of reduced cross section. Reference numeral 30 has been applied to indicate an overlay of a low fusing point metal, such as tin, capable of severing, by a metallurgical reaction with the base metal, i.e. silver, upon fusion of the overlay metal. The relatively wide section 27 is folded in a direction longitudinally thereof to form a U-shaped channel.

Because of their function to retain the heat in the center section 24 of the fusible elements F1, F2, the heat dam elements 26 are made from relatively narrow metal strips. Further the heat dam elements 26 have a melting $i^2.t$ value which is larger than the melting $i^2.t$ value of the center or perforated section 24 so that arc-initiation must occur at the center or perforated section and cannot occur in the heat dam elements 26.

Each of the heat dam elements 26 is fabricated from a single planar section of sheet material which is formed into a series of parallel planar sections 32 interconnected to one another by a series of U-shaped bends 34. In the embodiment shown there are three of such U-shaped bends 34 interconnecting four substantially parallel planar sections 32. Each of the heat dam elements 26 further includes a first substantially axially extending end section 36 which fits into and is electroconductively attached to a slot 37 provided in the inwardly facing surface 38 of one end terminal 14. A second axially extending planar section 40 of each heat dam element 26 is electroconductively attached, through a weld or solder joint 41, to the web portion 42 of the channel shaped center section 27 of the fusible element. The planar section 32, the U-shaped bends 34 and the end sections 36 and 40 cooperate to define a continuous tortuous path between the end sections 36 and 40. The heat dam elements are preferably fabricated from a metal other than silver such as, for example, copper or bronze.

Each of the heat dam elements 26 is provided with a pair of raised ribs 44 which are formed in the heat dam element, preferably but not necessarily, along the entire length thereof. The raised ribs 44 may be formed into the heat dam elements 26 during the forming operation which results in the interconnecting U-shaped bends 34, or alternatively may be formed by a separate forming operation once the heat dam elements 44 have been bent into the desired tortuous path. The raised ribs 44 serve to impart to each of the formed heat dam elements 26 a high degree of dimensional stability and rigidity particularly in the regions of the U-shaped bends 34. Such dimensional stability is extremely important in assuring consistent and reliable operation of electric fuses making use of such heat dam elements, particularly when the heat dam element is made from a relatively thin sheet material.

In order to fully appreciate the importance of rigidity and the resulting dimensional stability in the heat dam sections, it is necessary to appreciate that each of the fuse links F1, F2, as pointed out in the description of the prior art, is assembled as a unit prior to final assembly of the fuse. A particularly critical period in the assembly of a fuse is when it is in the partially assembled condition shown in FIG. 2, prior to the outside casing 12 being slid onto and attached to the end terminals 14. While in such condition, the heat dam sections 26 are subject to several handling steps which could readily result in deformation of the heat dams such that upon final assembly, as shown in FIG. 1, adjacent parallel planar sections 32 of one or more heat dams could be in relatively close proximity to one another resulting in a hot spot in a heat dam element and undesirable and premature opening of the fuse in the region of a heat dam as described in more detail in the description of the prior art.

Figure 3:
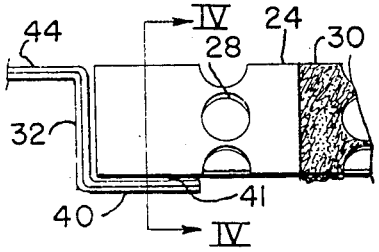
FIG. 3 is an enlarged view of the attachment between a heat dam section according to this invention and a fusible element.
Figure 4:
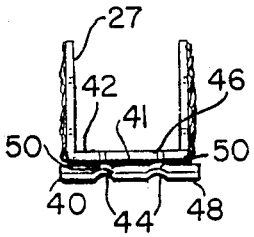
FIG. 4 is a section taken along the line IV—IV of FIG. 3.
Figure 5:
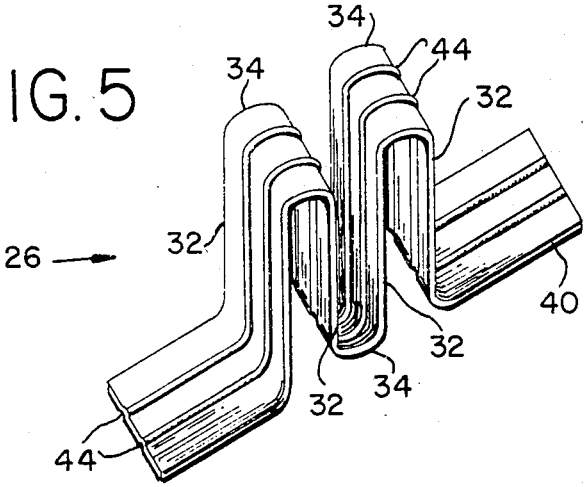
FIG. 5 is an enlarged perspective view of a heat dam element according to this invention.

Looking now to FIGS. 3 and 4 a further benefit of the raised ribs 44 formed in the heat dam elements 26 of the present invention will be appreciated. In the preferred embodiment the heat dam elements 26 are electroconductively attached to the wide center section 27 of the fusible element center section 24 by a welding operation with a first electrode (not shown) making contact underneath the heat dam element as at reference numeral 48 and a second electrode (not shown) making contact with the upper surface of the center section 27 as at reference numeral 46. As best seen in FIG. 4 the pair of raised ribs 44 in the heat dam element create two separate points of contact 50 with the bottom of the fusible element. This arrangement, advantageously, results in two regions of increased current density during the welding operation thereby facilitating a good sould electroconductive bond between the heat dam elements 26 and the fuse link center section 24.

Figure 6:
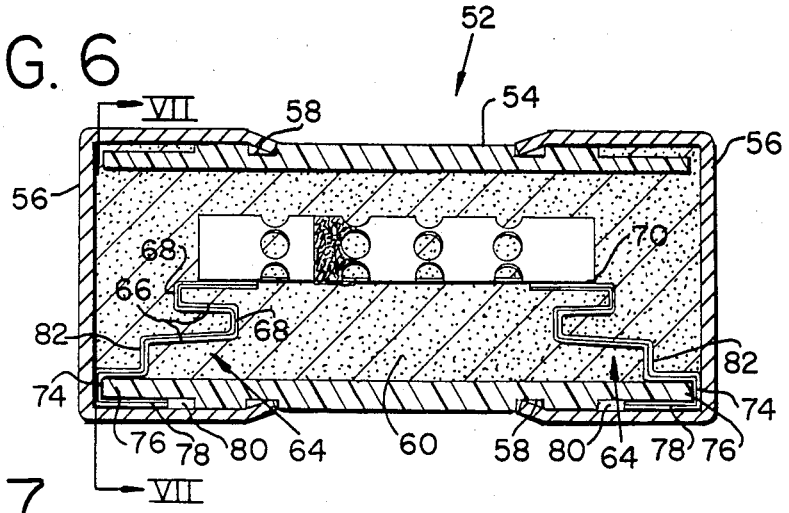
FIG. 6 is a longitudinal sectional view of another fuse embodying the invention.
Figure 7:
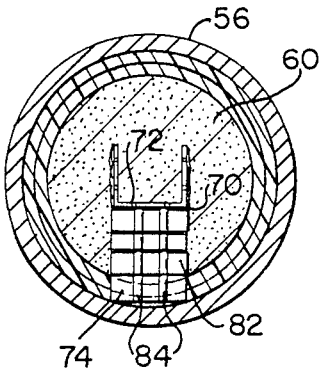
FIG. 7 is a sectional view taken along the line VII—VII of FIG. 6.
Figure 8:
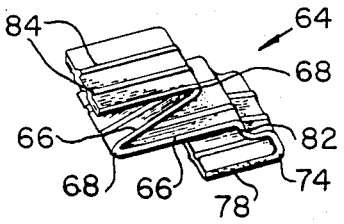
FIG. 8 is a perspective view of a heat dam element of the type used in the fuse shown in FIG. 6.

Turning now to FIGS. 6, 7 and 8, the invention is shown used in a cartridge electric fuse 52 of the "ferrule" type. The fuse comprises a cylindrical casing 54 of insulating material having both ends closed by cup-shaped end terminals 56, commonly referred to as ferrules. The end terminals 56 are affixed to the casing 54 by being suitably deformed or crimped into mating annular grooves 58 provided in the outer surface of the casing 54. The inside of the casing 54 is filled with an arc-quenching filler 60 as described in more detail in the previously described embodiment.

The fuse casing 54 houses a ribbon fuse link F3 which electrically conductively interconnects the two end terminals 56. The fuse link F3 includes a center section 62 and a pair of heat dam elements 64. The center section 62 is substantially identical, in configuration and manner of operation, to the center sections 24 of the fuse links F1 and F2 of the previously described embodiment. The heat dam section 64 performs the same function as those described above and are configured structurally differently only for the purpose of adapting to the different fuse construction shown in the present embodiment.

More specifically, each of the heat dams 64 is fabricated from a single planar section of sheet material which is formed into three substantially parallel planar sections 66 interconnected with one another by two U-shaped bends 68. One of the planar sections 66 is electroconductively attached through a weld or solder joint 70 to the web portion 72 of the center section 62. The other end of each heat dam 66 is formed into a C-shaped bend 74 which is adapted to extend around the axial outer end 76 of the fuse casing 54 with its outermost end 78 received in an anular groove 80 provided in the end of the casing and retained therein by one of the end terminals 56 to which it is electroconductively attached to complete the current path through the fuse. Each of the heat dams 64 also includes a vertical (as viewed in FIG. 6) section 82 which interconnects the C-shaped bend 74 and one of the planar sections 66. The vertical sections 82 are sized to achieve for each element assembly F3 the proper positioning of the fusible elements center section 62 with respect to the fuse casing. It will be appreciated that any deformation of the heat dams 64 during assembly of the fuse 52 could result in the inadequate filler/hot-spot problem described in connection with the previous embodiment and further could result in improper positioning of the fusible element 62 with respect to the fuse casing and the fuse problems associated with that. As in the previously described embodiment, the probability of such problems occurring are minimized in the present design by providing each of the heat dam elements 64 with a pair of longitudinally extending raised ribs 84 which extend the full length of each of the heat dams particularly through each of the bends formed in the heat dam sections to provide rigidity and the resulting dimensional stability in each of the heat dam sections 64.

Figure 9:
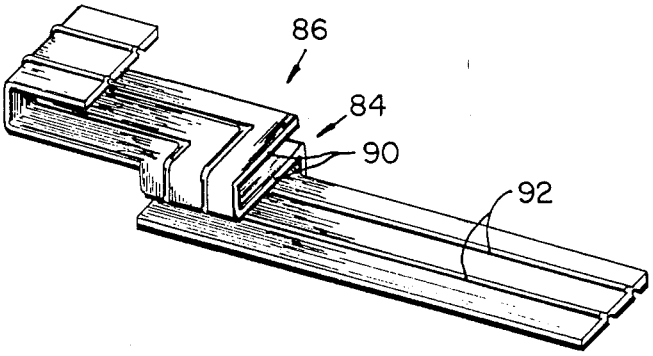
FIG. 9 is a perspective showing of still another embodiment of a heat dam element according to this invention.

Looking now to FIG. 9, a third embodiment of a heat dam 86 is shown wherein the tortuous path 88 formed by a plurality of interconnected planar sections 90 is formed with some sections extending in a transverse direction with respect to the axis of the fuse. As with the other embodiments described, this heat dam is provided with two formed reinforcing ribs 92 which extend along the full length of the element and, particularly through all of the interconnecting bends of the element.

It should be appreciated that, while in each of the embodiments shown the reinforcing ribs extend the full length of the element, such feature is not necessarily a requirement of the invention and it may be desirable in some fuse designs or circumstances to have the reinforcing ribs be intermittently formed in a heat dam for example the reinforcing ribs may be provided only in the regions of the bends of the heat dam elements.

Accordingly, it should be appreciated that the present invention provides a simple yet extremely effective structural configuration for achieving rigidity and dimensional stability in heat dam strip sections for use in electric fuses.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

What is claimed is:

1. An electric fuse comprising a tubular casing, terminal elements closing the ends of said casing, a pulverulent arc-quenching filler inside said casing, a fusible element embedded in said pulverulent arc-quenching filler and conductively interconnecting said terminal elements, said fusible element including a relatively wide center section extending longitudinally of the fuse casing, said center section defining a plurality of points of reduced cross section; a pair of relatively narrow heat dam sections for limiting the heat flow from said center section to said terminal elements, each of said heat dam sections comrising a first planar end section extending longitudinally of said fuse casing for attachment to one of said terminal elements, and a second planar end section extending longitudinally of said fuse casing for attachment to one end of said wide center section; a plurality of intermediate planar sections extending between said first and second end sections, each of said plurality of intermediate planar sections being interconnected to the adjacent planar section by a U-shaped bend, resulting in adjacent planar sections being in closely spaced parallel confronting relationship with one another; and at least one raised rib formed in each of said heat dam sections extending continuously from a predetermined location on said first planar end section completely through each of said intermediate planar sections and each of said U-shaped bends to a predetermined location on said second planar end section, whereby said continuous raised rib serves to maintain the spacing between said closely spaced parallel planar sections to assure that said pulverulent arc-quenching filler material will find its way between said adjacent planar sections.

2. The electric fuse of claim 1 wherein said raised rib extends the entire length of each of said heat dam sections.

3. The electric fuse of claim 1 wherein each of said heat dam sections has two of said raised ribs formed thereon and said raised ribs are parallel with one another and each of said ribs extends the entire length of said heat dam sections.

* * * * *